US005475472A

United States Patent [19]

Saito et al.

[11] Patent Number: 5,475,472

[45] Date of Patent: Dec. 12, 1995

[54] IMAGE PROCESS UNIT HAVING CHARGING MEMBER IMPEDANCE CORRECTION FEATURE

[75] Inventors: Masanobu Saito, Kawasaki; Masaharu Ohkubo, Yokohama, both of Japan

[73] Assignee: Canon Kabushiki Kaisha, Tokyo, Japan

[21] Appl. No.: 213,836

[22] Filed: Mar. 16, 1994

Related U.S. Application Data

[63] Continuation of Ser. No. 955,424, Oct. 2, 1992, abandoned.

[30] Foreign Application Priority Data

Oct. 4, 1991 [JP] Japan ..... 3-285569

[51] Int. Cl.[6] ..... G03G 15/02

[52] U.S. Cl. ..... 355/219; 361/225

[58] Field of Search ..... 355/200, 210, 355/211, 219, 221–223; 250/324–326; 361/225, 230, 235

[56] References Cited

U.S. PATENT DOCUMENTS

| | | | |
|---|---|---|---|
| 3,714,531 | 1/1973 | Takahashi | 250/324 X |
| 4,339,783 | 7/1982 | Kinashi et al. | 361/235 |
| 4,455,078 | 6/1984 | Mukai et al. | 355/219 |
| 4,500,195 | 2/1985 | Hosono | 355/219 X |
| 4,607,941 | 8/1986 | Honda | 355/221 X |
| 4,825,334 | 4/1989 | Kisler | 361/225 X |
| 5,060,016 | 10/1991 | Wanou et al. | 355/219 |

FOREIGN PATENT DOCUMENTS

| | | | |
|---|---|---|---|
| 0308185 | 3/1989 | European Pat. Off. | 355/219 |
| 0126047 | 9/1979 | Japan | 355/222 |
| 0117162 | 9/1980 | Japan | 355/222 |
| 0147756 | 8/1985 | Japan | 355/219 |
| 0214776 | 9/1988 | Japan | 355/219 |
| 0362057 | 3/1991 | Japan | 355/219 |

*Primary Examiner*—William J. Royer

*Attorney, Agent, or Firm*—Fitzpatrick, Cella, Harper & Scinto

[57] ABSTRACT

An image forming apparatus includes an image bearing member; a charging member for charging the image bearing member; an image forming device for forming an image on the image bearing member; and an impedance circuit between the charging member and a voltage source for supplying electric power to the charging member, the impedance circuit having an impedance which is peculiar to individual image forming apparatus in accordance with an impedance of the charging member.

23 Claims, 3 Drawing Sheets

IMAGE PROCESS UNIT HAVING CHARGING MEMBER IMPEDANCE CORRECTION FEATURE

This application is a continuation of prior application Ser. No. 07/955,424, filed on Oct. 2, 1992, now abandoned.

FIELD OF THE INVENTION AND RELATED ART

The present invention relates to an electrophotographic apparatus such as a copying machine or laser beam printer, an image forming apparatus such as an electrostatic recording apparatus, and a process unit detachably mountable thereto.

As for a means for charging or discharging an image bearing member (a member to be charged or discharged) such as a photosensitive member or dielectric member in an image forming apparatus such as an electrophotographic apparatus (copying machine, printer or image display apparatus) or an electrostatic recording apparatus, there is widely used a corona charger having a wire electrode and a shield electrode. The corona charger is effective as the means for uniformly charging the surface to be charged to a predetermined potential with a predetermined polarity.

However, a corona charger requires that an expensive high voltage transformer (6–8 KV) for providing a predetermined charge potential and a relatively large amount of ozone is produced by the corona discharge with the result of necessity for taking a measurement against it.

In place of the corona charger, there is a contact type charging device which is contacted to the member to be charged and supplied with a DC voltage or an oscillating voltage (the voltage having periodically changing voltage level) in the form of a DC biased AC voltage, by which the member is electrically charged or discharged.

The contact type charging device has advantages that the voltage of the voltage source can be reduced and that the amount of ozone production is small. Accordingly, it is particularly noted and gradually used as the charging means capable of taking place of the corona charger to charge or discharge the member to be charged such as photosensitive member (dielectric member or another image bearing member, in an image forming apparatus, for example).

For example, a conductive roller (charging roller) as the charging member is contacted to the surface of the photosensitive member surface (the member to be charged), and the charging roller is supplied with a positive or negative DC voltage of several hundreds—2 KV or such a voltage biased with an AC voltage, so that the photosensitive member surface is charged to several hundreds volt—1.5 KV.

Among the contact type charging devices, the one in which the charging member is supplied with an oscillating voltage is better in the uniform charging performance than the device supplied only with a DC voltage.

In the case where the charging member is supplied with an oscillating voltage in the form an AC voltage biased with a DC voltage, the electric discharge occurs from the charging member to the photosensitive member when the photosensitive member is insufficiently charged, whereas when the photosensitive member is excessively charged (it is charged higher than the voltage level of the DC component of the voltage source), the electric discharge occurs from the photosensitive member back to the charging member. By repeating the charging and back-charging by the frequency of the AC voltage, the surface potential of the photosensitive member converges to the DC voltage level of the voltage source.

The waveform of the oscillating voltage component may be a sine wave, rectangular wave, a triangular wave, or the like. The oscillating voltage may be produced by periodically actuating and deactuating the DC voltage. The oscillating voltage, thus, is a voltage having a periodically changing voltage level.

The charging member may be in the form of a roller, blade, brush, belt, or the like.

The contact type charging device is frequently used in a relatively low cost image forming apparatus in consideration of its advantages of the low cost, high voltage source and the non-necessity of the ozone filter. It is expected that the charging member is installed in a process cartridge which is detachably mountable to the image forming apparatus, and it is commercialized.

However, the impedance of the charging member varies for individual charging members, and therefore, the voltage drop is different if the charging member is different. For this reason, the potential of the photosensitive member to which the charging member charges, is different if the charging member is different.

In order to prevent leakage current through a pin hole of the photosensitive member from the charging member, it is considered that the charging member is covered with a surface layer having a high resistivity made of a material having a higher volume resistivity than the inner layer. However, if this is done, the high resistance layer tends to be influenced by the ambient humidity, so that the impedance increases under a low humidity condition by the increase of the resistance and the reduction of the dielectric constant; whereas under a high humidity condition, the impedance decreases due to the reduction of resistance and increase of dielectric constant.

For this reason, in a contact type charging device having a charging member supplied with an oscillating voltage or a process cartridge having the charging member, the impedance of the charging member decreases under the high humidity condition, so that the AC component of the voltage supplied to the charging member is directly supplied to the photosensitive member as a high voltage without attenuation of the AC component, with the possible result of dielectric break down of the photosensitive member.

If an AC voltage applied to the charging member from the voltage source is decreased in an attempt to avoid the dielectric break down of the photosensitive member in consideration of the reduction of the impedance of the charging member even under the high humidity condition, the dielectric break down of the photosensitive member could be prevented relative to the charging member.

However, when another charging member was connected with a voltage source having the lowered AC component voltage, and it was used under the high humidity condition, the dielectric break down of the photosensitive member occurred.

In order to investigate the causes, the impedance of the charging member was measured, and it was found that the impedance of the charging member of the latter case was lower than the impedance of the former charging member. Then, the AC voltage applied to the latter charging member was further lowered, and it was found that the dielectric break down of the photosensitive member could be avoided. However, when the former charging member having the higher impedance was used under the low humidity condition, the impedance of the charging member increased due to the low humidity condition, so that an AC component was attenuated with the result of uneven charging due to the insufficient AC voltage component.

It will be understood that since the impedances of individual charging members are different, the selection and setting of the AC voltage level for an impedance of a certain charging member, does not result in proper matching with the impedance of another charging member. Therefore, the result is either the dielectric break down of the photosensitive member under the high humidity condition or the occurrence of the uneven charging under the low humidity condition.

In order to prevent such problems, it is considered that the voltage source is adjusted for individual charging members, but it is cumbersome and time consuming. In the case where the image forming apparatus is used with a process cartridge with charging member, it is difficult for users to adjust the AC voltage of the voltage source in the image forming apparatus such as a copying machine, a laser beam printer or the like.

SUMMARY OF THE INVENTION

Accordingly, it is a principal object of the present invention to provide an image forming apparatus and a process unit in which a member to be charged is properly charged even if the impedances of the individual charging members are different.

It is another object of the present invention to provide an image forming apparatus and a process unit in which the member to be charged can be properly charged without necessity for adjustment of the output of a voltage source for the charging member even if the impedances of individual charging members are different.

It is a further object of the present invention to provide an image forming apparatus and a process unit in which the leakage current from a charging member to the image bearing member is effectively prevented.

It is a further object of the present invention to provide an image forming apparatus and a process unit in which an image bearing member can be properly charged irrespective of the humidity condition.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
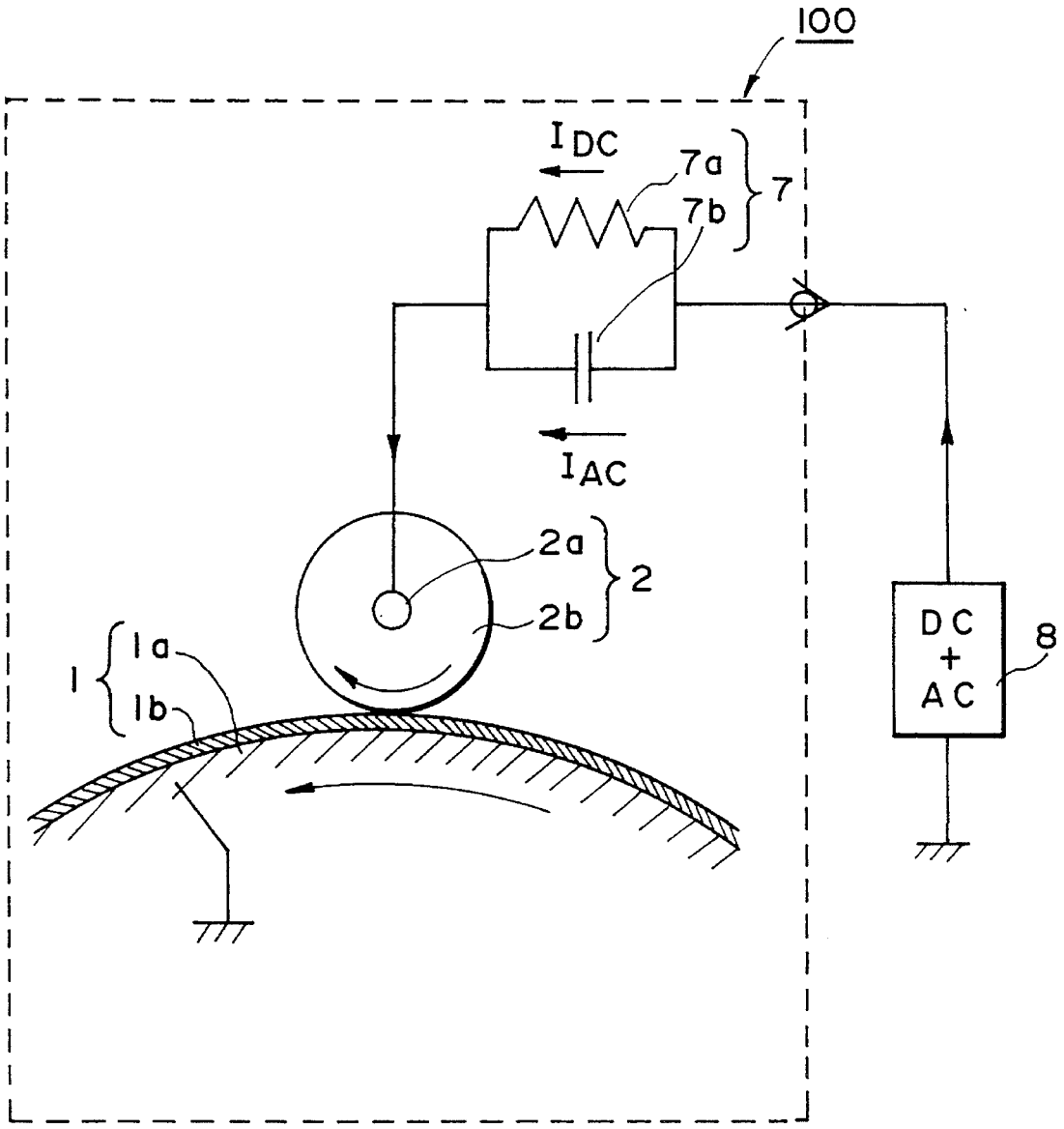
FIG. 1 is a sectional view of a charging device usable with an image forming apparatus according to an embodiment of the present invention.
Figure 2:
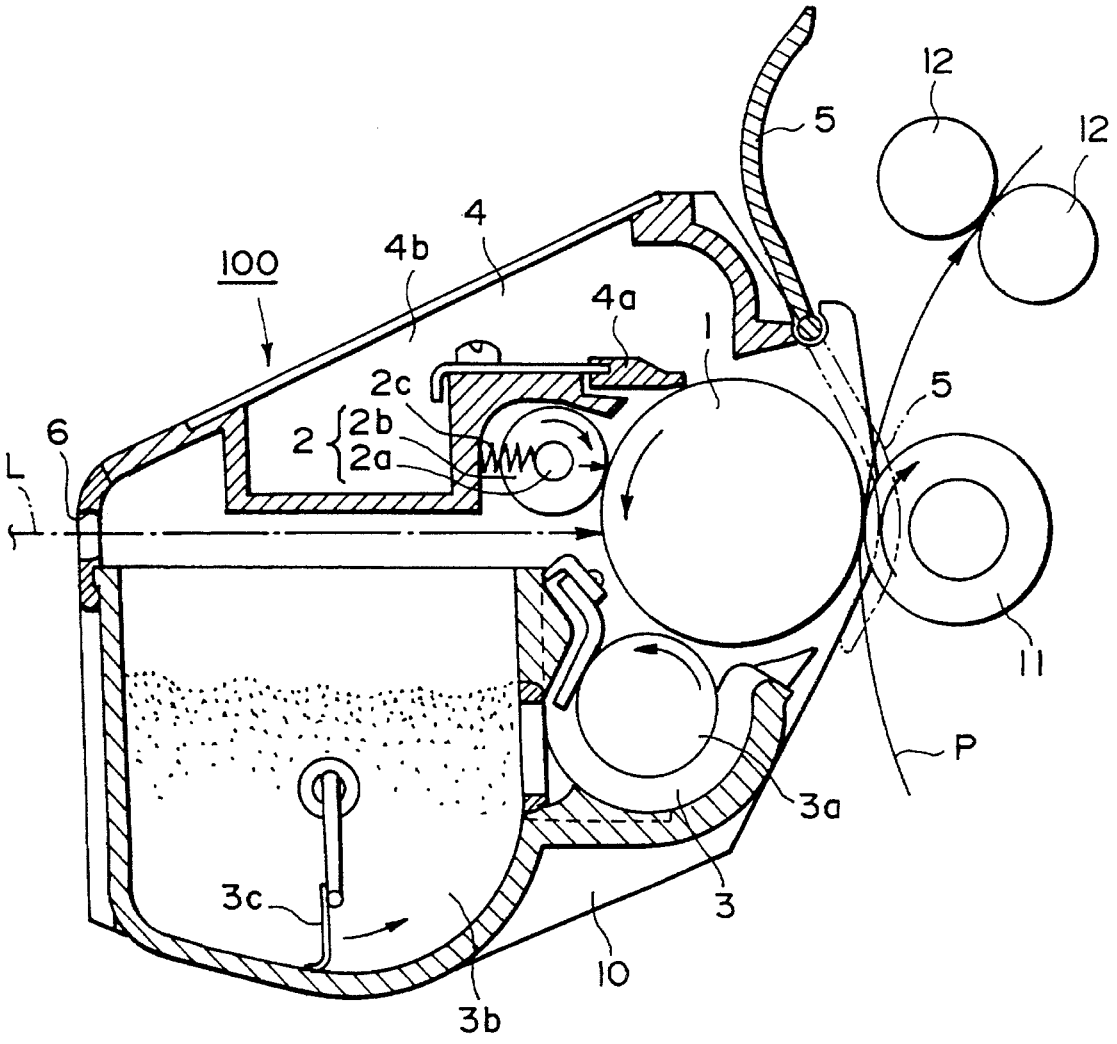
FIG. 2 is a sectional view of a process cartridge having a charging device according to an embodiment of the present invention.

Referring to the accompanying drawings, the embodiments of the present invention will be described. FIG. 1 illustrates a contact type charging device; FIG. 2 illustrates a process cartridge having the charging device.

Referring first to FIG. 2, there is shown a process cartridge 100 detachably mountable to an image forming apparatus. The cartridge 100 in this embodiment is designed for a transfer type electrophotographic apparatus. It comprises a housing 10, an image bearing member in a form of the photosensitive drum 1, a contact type charging member in the form of a charging roller 2, a developing device 3 and a cleaning device 4 (four process means).

The photosensitive drum 1 comprises a drum base la (FIG. 1) of electrically conductive material such as aluminum or the like, a photosensitive layer (photoconductive layer) **1*b* on the outer peripheral surface thereof. The photosensitive drum 1** is rotatably supported by unshown bearings adjacent opposite ends thereof.

The contact type charging member 2 comprises an electrically conductive metal core **2*a*, and a high resistance rubber roller 2*b* which is in the form of a roller coaxial with the metal core 2*a* and in which the carbon is dispersed. The charging roller 2 is extended substantially parallel with the photosensitive drum 1, and is rotatably supported by unshown bearings adjacent the opposite ends. It is normally press-contacted with a predetermined pressure to the surface of the photosensitive drum 1 by urging means 2*c* such as spring, and it rotates following rotation of the photosensitive drum 1. In a preferred type, the charging roller 2 comprises the metal core 2*a***, a conductive rubber layer thereon and a high resistance layer thereon having a higher volume resistivity than the conductive rubber layer for the purpose of current leakage to the photosensitive member. Preferably, the volume resistivity of the conductive rubber layer is not more than $10^3$ ohm.cm, and that of the high resistance layer is $10^6$ ohm.cm— $10^{10}$ ohm.cm.

The developing device 3 comprises a developing sleeve **3*a*, a toner container 3*b*, and a toner stirring member 3*c***.

The cleaning device 4 comprises a cleaning blade **4*a* press-contacted to the photosensitive drum and a toner container 4*b*** for accommodating the removed toner.

Designated by a reference numeral 5 is an openable protection cover (drum cover) of the cartridge 100. When the cartridge 100 is removed from the main assembly of the image forming apparatus, it is at the closed position indicated by chain lines to cover the surface of the photosensitive drum 1 to protect it from physical damage, deterioration by the external light, or the like. When it is loaded in place in the main assembly, it is at the open position indicated by solid line, so that a transfer means 11 is permitted to oppose or contact the photosensitive drum 1.

When the cartridge 100 is mounted in place in the main assembly of the image forming apparatus, the cartridge 100 is mechanically and electrically coupled with the main assembly of the image forming apparatus, so that the image forming apparatus can be operated.

In response to an image formation start signal, a driving source of the main assembly is operated so that the photosensitive drum 1 in the cartridge 100 is rotated in the counterclockwise direction (arrow) at a predetermined peripheral speed (process speed). The charging roller 2 rotates following the photosensitive drum 1. The developing sleeve **3*a* and the stirring member 3*c*** are also driven.

By the application of a predetermined voltage from a voltage source 8 (FIG. 1) in the main assembly to the contact type charging member 2, the surface of the rotating photosensitive drum 1 is uniformly charged to a predetermined potential in a predetermined polarity (negative in this embodiment). A light image L (slit exposure light from an original, a scanning laser beam or the like) is projected from an unshown light image exposure means in the main assembly of the image forming apparatus onto a photosensitive drum 1 through an exposure window 6 for the photosensitive drum 1, so that an electrostatic latent image is formed on the rotating photosensitive drum 1 surface corresponding to the light image.

The formed latent image is developed into a toner image by a developing device 3, and the toner image is sequentially transferred onto the transfer material supplied by an unshown sheet feeding mechanism to the transfer position between the photosensitive drum 1 and the transfer means 11.

The transfer material P now having the transferred toner image is separated from the surface of the photosensitive drum 1, and is directed to an image fixing device 12 where the image is fixed. Finally, the transfer material is discharged to the outside of the apparatus.

The surface of the photosensitive drum 1 after the separation of the transfer material P therefrom, is cleaned by the cleaning device 4 so that the residual toner other contaminates are removed therefrom, so as to be prepared for the repeated image forming operation.

As shown in FIG. 1, the charging roller 2 is connected with a voltage source 8 through a correction impedance circuit 7 comprising parallel-connected resistor 7*a* and a capacitor 7*b* for providing corrected impedance. The impedance correction circuit 7 is provided in a proper position in a process cartridge 100.

The voltage source 8 is outside the process cartridge 100, and generally, it is provided in the main assembly of the copying machine or the laser beam printer which receives the process cartridge 100. In this embodiment, the voltage source 8 is effective to apply to the charging roller 2 an oscillating voltage having an AC voltage component $V_{AC}$ and a DC component $V_{DC}$. Both of the AC voltage component and the DC voltage component are controlled to have constant voltage levels, as follows:

AC voltage component $V_{AC}$

Frequency: 150 Hz

Peak-to-peak voltage: 2200 Vpp

DC voltage component $V_{DC}$: −512 V

The AC current $I_{AC}$ is 312 μA, and a DC current $I_{DC}$ is approximately −4 μA. The AC current is fairly larger than the DC current, and therefore, the voltage attenuation due to the change of the impedance of the charging roller 2 is more influenced by the AC voltage component than by the DC voltage component.

The description will be made as to the AC voltage component necessary for the charging action of the charging roller 2. The voltage applied to the photosensitive drum 1 is equal to the voltage of the voltage source deducted by the voltage drop through the high resistance rubber layer 2*b*. Therefore, the peak-to-peak voltage between the conductive base 1*a* of the photosensitive drum 1 and the surface of the high resistance rubber layer 2*b* is influential to the photosensitive layer 1*b*. If this voltage is not less than 1100 Vpp, the charging is uniform, and if it is not higher than 1400 Vpp, the photosensitive layer 1*b* is not subjected to the dielectric break down even under the high humidity condition. Accordingly, for the purpose of proper charging of the photosensitive drum, $$1100V \leqq Vpp \leqq 1400\ V \ldots \quad (1)$$

This is the preferable peak-to-peak voltage applied on the surface of the photosensitive drum 1.

It is assumed that a charging roller A has an impedance of 0.8 MΩ under the normal humidity condition (23° C., 55% RH) and that the impedance thereof is 1.0 MΩ under the low humidity condition (15 ° C., 10% RH), and 0.6 MΩ under a high humidity condition (32° C., 85% RH).

When the charging roller A is connected to the voltage source 8 providing a peak-to-peak voltage of 2200 Vpp under the high humidity condition, the peak-to-peak voltage applied to the photosensitive member 1 surface is 1540 Vpp, with the result that the above condition (1) is not satisfied. The photosensitive drum 1 has been confirmed as having a constant impedance of 1.5 MΩ irrespective of the humidity condition.

It is possible to make adjustments by reducing the peak-to-peak voltage of the voltage source 8. In this embodiment, an impedance correcting circuit 7 (parallel-connected resistor 7*a* and capacitor 7*b*) having 0.3 MΩ is connected to the charging roller A. Then, the combined impedance (the combination of the impedance of the charging roller and the impedance of the impedance correction circuit) is 1.1 MΩ under the normal humidity condition, 1.3 MΩ under the low humidity condition, and 0.9 MΩ under the high humidity condition.

Then, the peak-to-peak voltage from the voltage source 8 (2200 Vpp) is attenuated through the high resistance rubber 2*b* of the charging roller A and the corrected impedance circuit 7, so that the voltage applied between the surface of the photosensitive layer and the base 1*a* of the photosensitive drum is:

1232 Vpp under the normal humidity condition;

1141 Vpp under the low humidity condition; and

1339 Vpp under the high humidity condition.

It will be understood that the conditions (1) are satisfied.

The resistance of a resistor 7*a* of the impedance correcting circuit 7 is 3 MΩ, and the capacity of the capacitor 7*b* is 3185 pF, the capacitance 3185 pF of the capacitor 7*b* functions as an impedance of 0.33 MΩ when an AC voltage having a frequency of 150 Hz is applied, and it is smaller than the impedance 3 MΩ of the resistance 7*a*. Therefore when the resistor 7*a* and the capacitor 7*b* are connected in parallel, the DC current mainly flows through the resistor 7*a*, and the AC current mainly flows through the capacitor 7*b*. Since the DC current $I_{DC}$ was −4 μA, the DC voltage drop through the impedance correction circuit 7 is determined by the resistance 7*a*, and is 12 V.

When an impedance of a charging roller B of another process cartridge is measured, it is 1.0 mΩ under the normal humidity condition. Therefore, an impedance correcting circuit 7 having an impedance which is not 0.3 MΩ is connected to the charging roller B so that the combined impedance is 1.1 MΩ as in the case of charging roller A. Then, the combined impedance is 1.1 MΩ under the normal humidity condition, 1.3 MΩ under the low humidity condition and 0.9 MΩ under the high humidity condition.

The peak-to-peak voltage 2200 Vpp from the voltage source 8 is attenuated by the high resistance rubber 2*b* of the charging roller B and the impedance correcting circuit 7, so that the voltage between the surface of the photosensitive layer and the base 1*a* is:

1232 Vpp under the normal humidity condition;

1141 Vpp under the low humidity condition; and

1339 Vpp under the high humidity condition.

Thus, the conditions (1) are satisfied as in the case of charging roller A.

The resistance of the resistor 7*a* of the impedance correcting circuit 7 is 3 MΩ, and the capacitance of the capacitor 7b is 10260 pF. Since the DC current flows through the resistor 7a, the resistance of the resistor 7a is equally 3 MΩ, by which the DC voltage drop is equally 12 V as in charging roller A. The DC voltage applied to the charging roller is −500 V which is the DC voltage component of the voltage source 8 (−512 V) deducted by 12 V which is the voltage drop through the resistor 7a. Thus, the surface potential of the photosensitive drum 1 is equal to the DC voltage applied to the charging roller. In other words, even if the AC voltage attenuation is changed by connection of the impedance correcting circuit 7 to the charging roller A or charging roller B, the voltage drop of the DC component can be made constant, and therefore, the surface potential of the photosensitive drum 1 for the process cartridge 100 can be made constant.

The results are summarized in the following Tables 1 and 2.

(a) Charging roller A with impedance correcting circuit of 0.3 MΩ

TABLE 1

| AMBIENCE | NORMAL H. 23° C. 55% | LOW H. 15° C. 10% | HIGH H. 32° C. 85% |
|---|---|---|---|
| ROLLER A | 0.8 MΩ | 1.0 MΩ | 0.6 MΩ |
| IMP. CORRECTING CKT | PARALLEL CON. OF 3 MΩ & 3185 pF (0.3 MΩ) | | |
| SYN. IMP. CKT | 1.1 MΩ | 1.3 MΩ | 0.9 MΩ |
| SOURCE VOLT | 2200 Vpp AC, −512 V DC | | |
| DC VOLT TO ROLLER A | −500 V | | |
| Vpp ON DRUM SURFACE | 1232 V | 1141 V | 1339 V |

(b) Charging roller B with impedance correcting circuit of 0.1 MΩ

TABLE 2

| AMBIENCE | NORMAL H. 23° C. 55% | LOW H. 15° C. 10% | HIGH H. 32° C. 85% |
|---|---|---|---|
| ROLLER B | 1.0 MΩ | 1.2 MΩ | 0.8 MΩ |
| SYN. IMP. CKT | 1.1 MΩ | 1.3 MΩ | 0.9 MΩ |
| IMP. CORRECTING CKT | PARALLEL CON. OF 3 MΩ & 1026 pF (0.1 MΩ) | | |
| SOURCE VOLT | 2200 Vpp AC, −512 V DC | | |
| DC VOLT TO ROLLER B | −500 V | | |
| Vpp ON DRUM SURFACE | 1232 V | 1141 V | 1339 V |

Thus, if the charging roller A having the impedance of 0.8 MΩ under the normal humidity condition and the charging roller B having an impedance of 1.0 MΩ, may be adjusted so as to have the same combined impedance of 1.1 MΩ if the impedance correcting circuit 7 has 0.3 MΩ and 0.1 MΩ, respectively. Therefore, the same voltage source 8 (2200 Vpp) is usable. The charging efficiency decreases with increase of the combined impedance, and therefore, the combined impedance is preferably lower than the impedance of the photosensitive drum.

Figure 3:
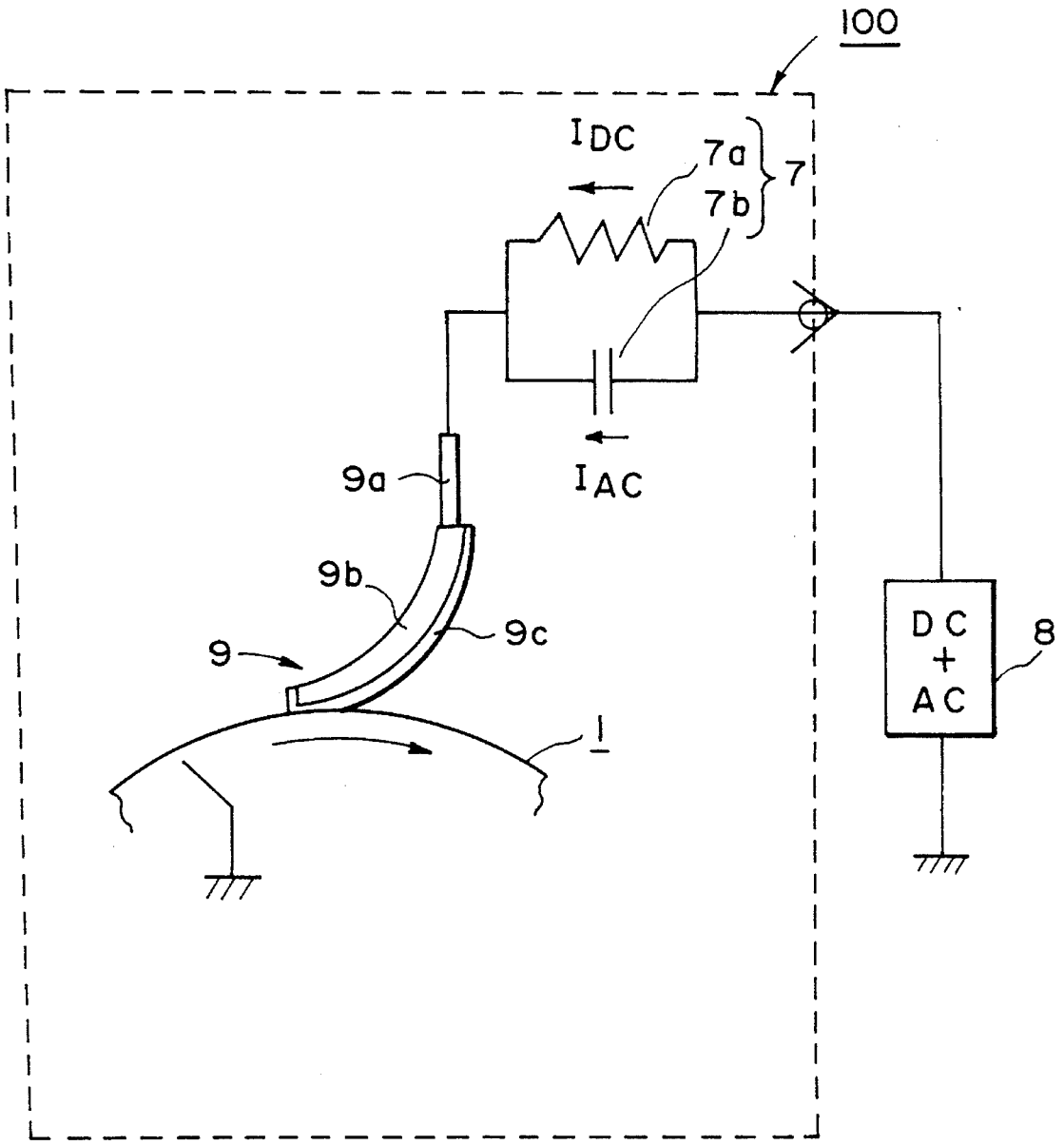
FIG. 3 is a sectional view of a charging device in the form of a charging blade.

The contact charging member may be in the form of a charging blade 9 as shown in FIG. 3, in place of charging roller. The charging blade 9 comprises a blade base 9b made of urethane rubber, NBR (nitrile butadiene rubber) or EPDM (tarcopolymer of ethylenepropylenediene) or the like, a surface layer 9c of Toresin (trade name of N-methoxymethyl nylon, available from Teikoku Kagaku Sangyo Kabushiki Kaisha, Japan) or epichlorohydrin rubber, and a metal supporting plate 9a. In the case of the charging blade 9, the variations of the impedances of the individual blades, can be corrected by the impedance correcting circuits 7 as in the case of the charging roller, so as to maintain the attenuation of the AC voltage component, so that the same voltage source is usable.

The charging member may be in the form of a brush, belt, or the like. The waveform of the oscillating voltage is a sine wave, rectangular wave or triangular wave. The oscillating voltage may be a rectangular wave provided by periodically actuating and deactuating the DC voltage source. The oscillating voltage is a voltage having periodically changing voltage level. The voltage applied to the charging member is not limited to the oscillating voltage, but it may be a DC voltage. However, when the DC voltage is applied, the uneven image tends to be produced due to the uneven charging as compared with the case of vibratory voltage application.

The process cartridge shown in FIG. 2 may contain at least the charging member and the correcting impedance circuit.

As described in the foregoing, according to the present invention, the impedance variations of the individual charging members can be accommodated in an image forming apparatus or a process cartridge. Therefore, the individual charging devices can be connected to a fixed voltage of the voltage source so as to prevent both of the dielectric break down of the member to be charged and the unevenness of the charging. Since the impedance correcting circuit comprises a resistor and a capacitor connected in parallel, and the resistance of the resistor is constant, the DC voltage drop is maintained constant, so that the surface potential of the photosensitive member can be made constant. On the other hand, the adjustment of the attenuation of the AC component by the combined impedance of the charging member and the impedance correcting circuit, can be changed by changing the capacity of the capacitor.

While the invention has been described with reference to the structures disclosed herein, it is not confined to the details set forth and this application is intended to cover such modifications or changes as may come within the purposes of the improvements or the scope of the following claims.

What is claimed is:

1. A process unit, comprising:

an image bearing member;

a charging member contactable to said image bearing member for charging said image bearing member, said charging member having an inherent impedance which varies from one individual process unit to another;

image forming means for forming an image on said image bearing member; and an impedance circuit between said charging member and a voltage source for supplying electric power to said charging member, said impedance circuit having an impedance which is determined as a function of the impedance of said charging member.

2. A process unit according to claim 1, wherein said process unit contains said image bearing member.

3. A process unit according to claim 2, further comprising developing means for forming a developed image on said image bearing member.

4. A process unit according to claim 1, wherein said impedance circuit has an impedance selected for an individual process unit.

5. A process unit according to claim 4, wherein a combined impedance of said impedance circuit and an impedance of said charging member is substantially constant for individual process units.

6. A process unit according to claim 1, wherein said charging member is in the form of a roller.

7. A process unit according to claim 1, wherein a combined impedance of said charging member and said impedance circuit is smaller than an impedance of said image bearing member.

8. A process unit according to claim 1, wherein the electric power is an oscillating voltage.

9. A process unit according to claim 8, wherein the electric power is a DC biased AC voltage.

10. A process unit according to claim 1 or 6, wherein said impedance circuit comprises a resistor and a capacitor.

11. A process unit according to claim 10, wherein the resistor and the capacitor are connected in parallel.

12. A process unit according to claim 11, wherein a resistance of the resistor is constant for an individual process unit.

13. A process unit detachably mountable to an image forming apparatus, comprising:

an image bearing member for bearing an image;

a charging member contactable to said image bearing member for charging said image bearing member, said charging member having an inherent impedance which may vary from one individual process unit to another; and an impedance circuit connected between said charging member and a voltage source for supplying electric power to said charging member, said impedance circuit having an impedance which is determined as a function of the impedance of said charging member.

14. A process unit according to claim 13, wherein said impedance circuit has an impedance selected for an individual process unit.

15. A process unit according to claim 13, wherein a combined impedance of said impedance circuit and an impedance of said charging member is substantially constant for individual process units.

16. A process unit according to claim 13, wherein the electric power is an oscillating voltage.

17. A process unit according to claim 16, wherein the electric power is a DC biased AC voltage.

18. A process unit according to claim 13 or 16, wherein said impedance circuit comprises a resistor and a capacitor.

19. A process unit according to claim 18, wherein the resistor and the capacitor are connected in parallel.

20. A process unit according to claim 13, wherein said charging member is in the form of a roller.

21. A process unit according to claim 13, further comprising developing means for forming a developed image on said image bearing member.

22. A process unit according to claim 19, wherein a resistance of the resistor is constant for an individual process unit.

23. A process unit according to claim 13, wherein a combined impedance of said charging member and said impedance circuit is smaller than an impedance of said image bearing member.

* * * * *

UNITED STATES PATENT AND TRADEMARK OFFICE

CERTIFICATE OF CORRECTION

PATENT NO. : 5,475,472

DATED : December 12, 1995

INVENTOR(S) : MASANOBU SAITO, et al.

It is certified that error appears in the above-indentified patent and that said Letters Patent is hereby corrected as shown below:

COLUMN 4

Line 18, "the carbon" should read --carbon--.

COLUMN 5

Line 20, "toner other" should read --toner or other--.
Line 60, "break down" should read --breakdown--.

COLUMN 7

Line 6, "deducted" should read --reduced--.

UNITED STATES PATENT AND TRADEMARK OFFICE

CERTIFICATE OF CORRECTION

PATENT NO. : 5,475,472 Page 2 of 2

DATED : December 12, 1995

INVENTOR(S) : MASANOBU SAITO, et al.

It is certified that error appears in the above-indentified patent and that said Letters Patent is hereby corrected as shown below:

COLUMN 8

Line 28, "break" should read --break- --.

Signed and Sealed this

Thirtieth Day of April, 1996

Bruce Lehman

*Attest:*

BRUCE LEHMAN

*Attesting Officer*

*Commissioner of Patents and Trademarks*